US010959477B2

(12) United States Patent
Nordin et al.

(10) Patent No.: US 10,959,477 B2
(45) Date of Patent: Mar. 30, 2021

(54) EAR MUFF ATTACHMENT HAVING DUAL AXIS OF ROTATION

(71) Applicant: 3M INNOVATIVE PROPERTIES COMPANY, St. Paul, MN (US)

(72) Inventors: Henrik Nordin, Forsheda (SE); Sigvard Nilsson, Värnamo (SE); Emil J. Jönsson, Malmö (SE)

(73) Assignee: 3M Innovative Properties Company, St. Paul, MN (US)

( * ) Notice: Subject to any disclaimer, the term of this patent is extended or adjusted under 35 U.S.C. 154(b) by 226 days.

(21) Appl. No.: 15/307,423

(22) PCT Filed: Apr. 23, 2015

(86) PCT No.: PCT/US2015/027296

§ 371 (c)(1),
(2) Date: Oct. 28, 2016

(87) PCT Pub. No.: WO2015/167924

PCT Pub. Date: Nov. 5, 2015

(65) Prior Publication Data

US 2017/0049179 A1 Feb. 23, 2017

Related U.S. Application Data

(60) Provisional application No. 61/987,873, filed on May 2, 2014.

(51) Int. Cl.
*A42B 3/16* (2006.01)

(52) U.S. Cl.
CPC ..... *A42B 3/166* (2013.01)

(58) Field of Classification Search
CPC ..... A42B 3/166; A42B 3/16; A42B 3/163
USPC ..... 2/423, 6.2
See application file for complete search history.

(56) References Cited

U.S. PATENT DOCUMENTS

| | | | |
|---|---|---|---|
| 783,338 | A | 2/1905 | Ward |
| 2,649,019 | A | 8/1953 | Hartline |
| 3,197,785 | A | 8/1965 | Simpson |
| 3,400,406 | A | 9/1968 | Aileo |

(Continued)

FOREIGN PATENT DOCUMENTS

| | | |
|---|---|---|
| AU | 2013-101441 | 1/2014 |
| DE | 3343492 | 6/1984 |

(Continued)

OTHER PUBLICATIONS

International Search Report for PCT International Application No. PCT/US2015/027296, dated Jul. 16, 2015, 4 pages.

*Primary Examiner* — Alissa L Hoey
(74) *Attorney, Agent, or Firm* — Katherine M. Scholz; Dena M. Ehrich; Christopher D. Karlen

(57) ABSTRACT

The present description provides an ear muff attachment assembly. An exemplary ear muff attachment assembly (100) includes a housing (110), an ear muff (130), an arm (120) having first and second end regions, the first end region positioned within the housing and the second end region attached to the ear muff, and a spring (150) engaged to the housing and the first end region of the arm. The arm is rotatable about a first axis of rotation between a first position and an intermediate position, and about a second axis of rotation between the intermediate position and a second position.

13 Claims, 5 Drawing Sheets

(56) References Cited

U.S. PATENT DOCUMENTS

| | | | | |
|---|---|---|---|---|
| 3,430,261 | A | 3/1969 | Benner | |
| 3,721,993 | A | 3/1973 | Lonnstedt | |
| 3,795,919 | A | 3/1974 | Aho | |
| 4,027,341 | A * | 6/1977 | Patteri | A42B 3/166 2/209 |
| 4,104,743 | A * | 8/1978 | Bottger | A42B 3/166 2/423 |
| 4,186,447 | A | 2/1980 | Palmaer | |
| 4,224,694 | A | 9/1980 | Palmaer | |
| 4,316,290 | A | 2/1982 | Montesi | |
| 4,347,631 | A | 9/1982 | Newcomb | |
| 4,375,702 | A | 3/1983 | Lundin | |
| 4,547,908 | A | 10/1985 | Karlsson | |
| 4,944,361 | A | 7/1990 | Lindgren | |
| 5,239,703 | A | 8/1993 | Nordin | |
| 5,546,610 | A | 8/1996 | Herzig | |
| 7,283,641 | B2 | 10/2007 | Rolla | |
| 7,320,152 | B2 | 1/2008 | Lowry | |
| 8,028,344 | B2 * | 10/2011 | Rogers | A42B 3/166 2/422 |
| 2007/0226865 | A1 | 10/2007 | Lindgren | |
| 2010/0281605 | A1 | 11/2010 | Pereira | |
| 2013/0205477 | A1 | 8/2013 | Pfanner | |
| 2013/0219598 | A1 | 8/2013 | Pfanner | |
| 2016/0095376 | A1 * | 4/2016 | Schrader | A42B 3/166 2/410 |
| 2016/0324248 | A1 * | 11/2016 | Winters | A42B 3/30 |
| 2017/0340046 | A1 * | 11/2017 | Le | A61F 11/06 |
| 2018/0168270 | A1 * | 6/2018 | Vaccaro | H04R 1/1066 |

FOREIGN PATENT DOCUMENTS

| | | |
|---|---|---|
| DE | 4234216 | 12/1993 |
| ES | 271078 | 8/1983 |
| GB | 1456956 | 12/1976 |
| JP | 2009-024312 | 2/2009 |
| JP | 2010-018933 | 1/2010 |
| WO | WO 1986-03656 | 7/1986 |

* cited by examiner

EAR MUFF ATTACHMENT HAVING DUAL AXIS OF ROTATION

CROSS REFERENCE TO RELATED APPLICATIONS

This application is a national stage filing under 35 U.S.C. 371 of PCT/US2015/027296, filed Apr. 23, 2015, which claims the benefit of Provisional Application No. 61/987,873, filed May 2, 2014, the disclosure of which is incorporated by reference in its/their entirety herein.

The present invention pertains to an ear muff attachment mechanism that rotates about first and second axes between an active position and a standby position.

BACKGROUND

The use of hearing protective and noise isolating devices are well known, and various types have been considered. Such devices include ear muffs that are placed over the ear of a user to physically obstruct the passage of sound waves into the inner ear. Ear muffs typically include a cup-shaped shell including a sound absorber or liner. Ear muffs may be supported on or around the head of a user by a head band, strap, helmet or other headpiece. Helmets, such as hard hats, and other head gear may be worn with ear muffs including an arm that attach to the helmet and may be adjustable between various positions over or away from a user's ear. Various helmet mounted ear muffs are available, such as 3M PELTOR X SERIES helmet mounted ear muffs available from 3M Co. of St. Paul, Minn.

SUMMARY OF THE INVENTION

Prior helmet mounted devices often require the same level of force to rotate into an active position as required to rotate to a standby position. Accordingly, range of motion of the ear muff is often intentionally limited to avoid an excessive force to move the ear muffs into an active position and to limit a force exerted by a pre-stressed component of the assembly when in a standby position. An ear muff attachment assembly according to the present description may be configured such that a maximum force to move an ear muff into an active position is different (e.g. less than) a maximum force to move the ear muff into the standby position. Desired force levels and range of motion may be provided while providing an ear muff attachment assembly that is easy to use and minimizes force of a pre-stressed component when in a standby position.

The present description provides an ear muff attachment assembly including a housing, an ear muff, an arm having first and second end regions, the first end region positioned within the housing and the second end region attached to the ear muff, and a spring engaged to the housing and the first end region of the arm. The arm is rotatable about a first axis of rotation between a first position and an intermediate position, and about a second axis of rotation between the intermediate position and a second position.

The present description further provides an ear muff attachment assembly including a helmet and first and second ear muff assemblies attached to the housing. Each of the first and second ear muff assemblies include a housing having a first lever seat defining a first axis of rotation, an arm including first and second end regions, the first end region having a second lever seat defining a second axis of rotation, and the second end region including an ear muff, and a spring engaged to the housing and the first end region of the arm within the housing. The arm is rotatable about the first axis of rotation between a first position and an intermediate position, and about the second axis of rotation between the intermediate position and a second position. The ear muffs are in an active position when the arm is in the first position and are in a standby position when the arm is in the second position.

The above summary of the present invention is not intended to describe each disclosed embodiment or every implementation of the present invention. The Figures and the Detailed Description, which follow, more particularly exemplify illustrative embodiments.

BRIEF DESCRIPTION OF THE DRAWINGS

The present description will be further explained with reference to the appended Figures, wherein like structure is referred to by like numerals throughout the several views, and wherein.

While the above-identified figures set forth various embodiments of the disclosed subject matter, other embodiments are also contemplated. In all cases, this description presents the disclosed subject matter by way of representation and not limitation. It should be understood that numerous other modifications and embodiments can be devised by those skilled in the art which fall within the scope and spirit of the principles of this description.

DETAILED DESCRIPTION

The present description provides an ear muff attachment assembly that allows a user to move an ear muff between an active position and a standby position. The ear muff attachment assembly includes a housing, an ear muff, and an arm engaged with the housing and the ear muff. The arm is rotatable about a first axis of rotation between a first position and an intermediate position, and about a second axis of rotation between the intermediate position and a second position. Rotation about first and second axes allows a force required for rotation into an active position to differ from a force required for a user to rotate the ear muffs into a standby position. For example, less force may be required to position the ear muffs over the user's ear than to position the ear muffs away from a user's ear. Accordingly, an ear muff attachment assembly as described herein allows a user to more easily move ear muffs between an active position and a standby position while reducing stress on components to maximize usable life of the assembly.

Figure 1:
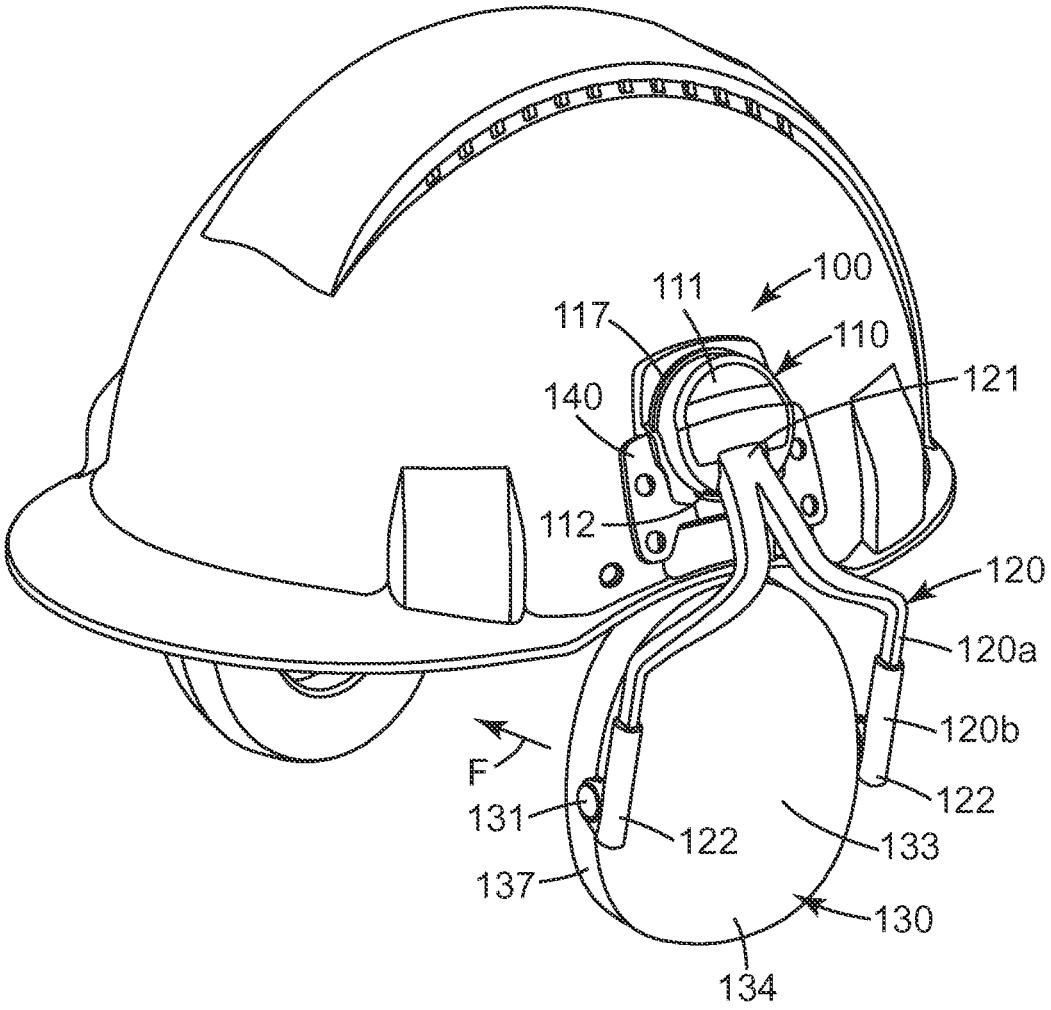
FIG. 1 is a perspective view of a helmet and exemplary ear muff attachment assembly 100 according to the present description.
Figure 2:
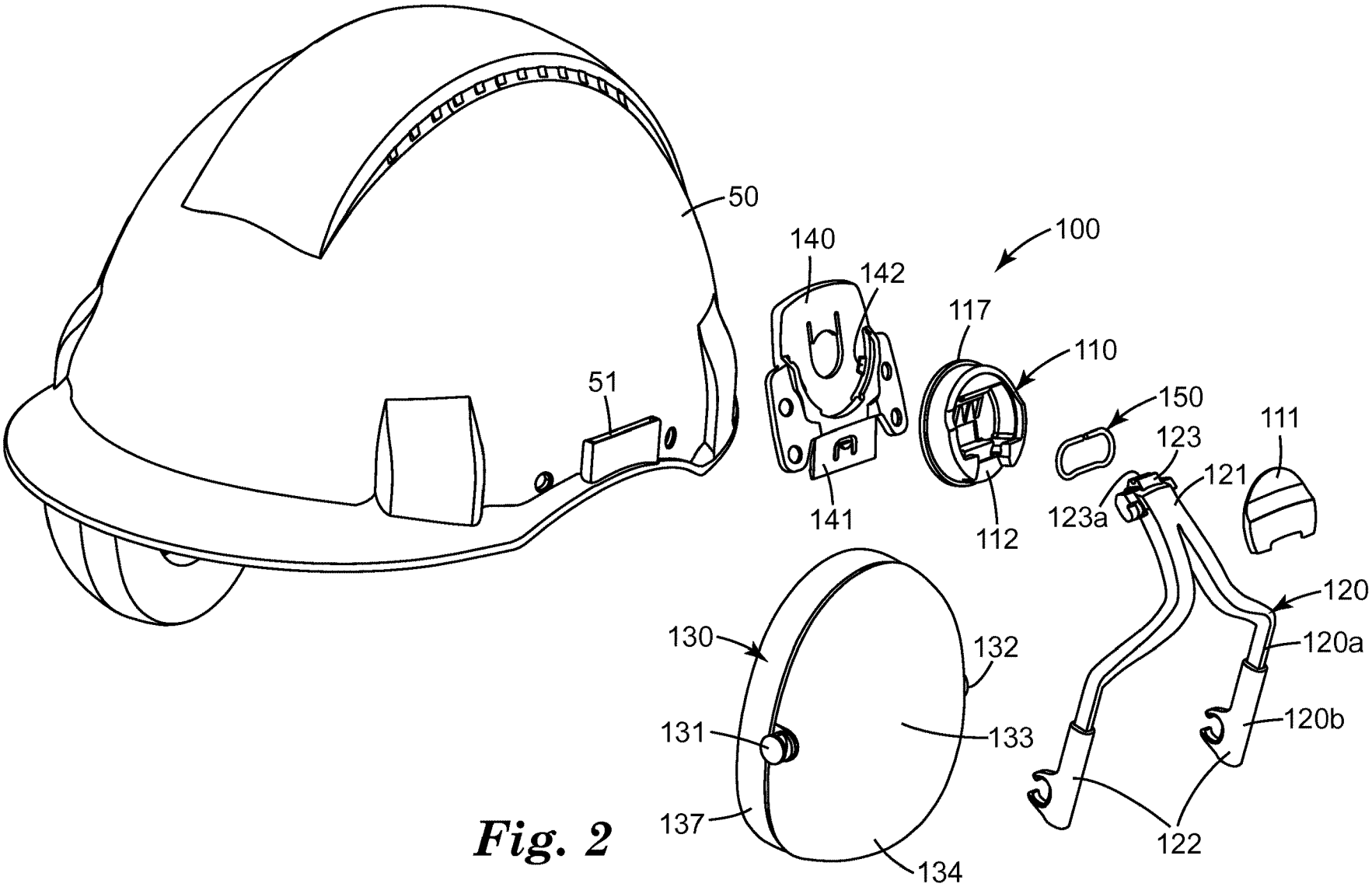
FIG. 2 is an exploded view of a helmet and exemplary ear muff attachment assembly 100 according to the present description.

FIGS. 1 and 2 show an exemplary ear muff attachment assembly 100 including a housing 110, an arm 120 and ear muff 130. Arm 120 is rotatable between a first position and an intermediate position, and between the intermediate position and a second position, such that ear muff 130 may be adjusted and/or toggled, for example, between active and standby positions. In an active position, ear muff 130 is configured to at least partially cover a user's ear. In a standby mode, ear muffs 130 are in a raised position away from and/or out of contact with a user's head. A user is able to switch between active and standby positions when entering or leaving an area necessitating hearing protection, for example, or as may be desired by the user. Adjustment to a standby position allows ear muffs 130 to be readily available for the user to move ear muffs 130 into an active position in which hearing protection is provided without the need to carry or store ear muffs.

Housing 110 may be attached directly or indirectly to a helmet, hard hat, strap, head band, or other head support, such as a helmet 50 shown in FIG. 1, for example. Helmet 50 may be worn simultaneously with, and provide a support for, ear muff attachment assembly 100. Housing 110 is attached to an outer surface of helmet 50, and arm 120 extends generally downwardly around an edge of helmet 50 such that ear muffs 130 may be desirably positioned to cover a user's ear. A second housing 110 and ear muff assembly 100 is similarly attached to an opposite side of helmet 50.

In an exemplary embodiment, housing 110 is attached to a helmet 50 via an adapter 140. Adapter 140 includes a tab or protrusion 141 received by a complementary feature 51, such as slot, opening, projection, or other suitable feature, of helmet 50. Adapter 140 and housing 110 include complementary features that interact to provide a permanent or releasable engagement. For example, housing 110 includes a flange 117 that is slidably received in one or more slots 142 of adapter 140 and frictionally or mechanically retained. In various exemplary embodiments, helmet 50, housing 110, and/or adapter 140 may also be joined using various other suitable components, such as snap-fit components, rivets, mechanical fasteners, adhesive, or other suitable attachment components as known in the art.

Ear muff 130 is configured to cover at least a portion of a user's ear and/or head. In an exemplary embodiment, ear muff 130 exhibits a cup shape and includes a cushion 137 and a sound absorber (not shown). Cushion 137 is configured to contact a user's head and/or ear when ear muff 130 is in an active position forming an appropriate seal to prevent sound waves from entering.

Arm 120 extends outwardly from housing 110 and is configured to carry ear muff 130. Arm 120 includes a first end region 121 proximate housing 110 and a second end region 122 spaced from first end region 121. In an exemplary embodiment, first end region 121 extends through an opening 112 in housing 110 and is engaged with spring 150 within housing 110. Second end region 122 of arm 120 is attached to ear muff 130. In an exemplary embodiment, arm 120 has a "Y" or branched shape such that second end region 122 of arm 120 includes two or more portions joined to ear muff 130 at attachment locations 131, 132 on first and second sides of ear muff 130. In other exemplary embodiments, second end region 122 of arm 120 may be attached to an attachment location 133 on an outer face 134, or one or more other locations, of ear muff 130.

In an exemplary embodiment, second end region 122 of arm 120 is rotatably attached to ear muff 130. A rotatable attachment allows ear muff 130 to rotate or pivot relative to arm 120 to facilitate a comfortable fit and robust seal with a user's head and/or ear. In some exemplary embodiments, arm 120 may have an adjustable length, for example by frictionally engaged concentric portions 120*a* and 120*b*, such that a vertical position of ear muff 130 may be adjusted to accommodate a range of user head sizes and/or desired positionings.

Arm and housing may be made of any suitable material that provides sufficient stiffness and durability such that arm 120 and ear muff 130 may be repeatedly moved between first and second positions. In an exemplary embodiment, arm 120 is made of an acetal and housing 110 is made of a polyamide, such as a glass fiber reinforced polyamide.

Ear muff attachment assembly 100 includes a spring 150 that engages housing 110 and arm 120. In an exemplary embodiment, spring 150 is formed from a resilient metal wire having a cylindrical cross-section and flexed into a generally oval or ring shape. A first spring engagement portion 151 engages housing 110 at a housing spring retention feature 113. Housing spring retention feature 113 may include a recess 113*a*, or other feature complementary to spring 150, such that spring 150 may be retained in an engaged position during normal use of ear muff attachment assembly 100. A second spring engagement portion 152 engages first end region 121 of arm 120 at an arm spring retention feature 123. Arm spring retention feature 123 may include a recess 123*a*, or other feature complementary to spring 150, such that spring 150 may be retained in an engaged position during normal use of ear muff attachment assembly 100. In various exemplary embodiments, spring 150 may include a coil spring, leaf spring, or other suitable spring as known in the art, and/or may be integral to housing 110 and/or arm 120.

In an exemplary embodiment, spring 150 is rotatably engaged with arm 120 and housing 110 such that spring 150 is able to rotate relative to housing 110 and/or arm 120 at first and second spring engagement portions 151, 152. That is, first and second spring engagement portions 151, 152 are able to rotate about first and second spring axes 30, 40, for example.

Spring 150 exerts a spring force (Fs) resulting from compression or activation of spring 150. In an exemplary embodiment, spring force (Fs) results from compression of spring 150 from a neutral or initial spring length (Li) to a spring length (Ls), for example between first and second engagement locations 151, 152. Compression or activation of spring 150 results in a spring force (Fs) on first end region 121 of arm 120 that may act to move arm 120 towards a first or second position. In some exemplary embodiments, spring force (Fs) is proportional to compression of spring 150 multiplied by spring constant (K) and thus varies with spring length (Ls) as arm 120 moves between first and second positions.

Spring force (Fs), and the geometry and configuration of ear muff attachment assembly 100, results in a force (F) exerted at second end regions 122 and ear muffs 130 that varies based on the position of arm 120. For example, when in an active position, force (F) pushes ear muff 130 towards a user's ear. Force (F) acts to retain ear muff 130 in the active position and facilitates a seal between ear muff 130 and the user's ear and/or head to physically prevent sound from entering a user's ear. As arm 120 is moved between a first position and an intermediate position, force (F) acts to return arm 120 and ear muff 130 to the first position. Similarly, as arm 120 is moved between a second position and an intermediate position, force (F) acts to return arm 120 and ear muff 130 to the second position. In an exemplary embodiment, force (F) is approximately zero at the intermediate position. That is, in an exemplary embodiment, force (F) is approximately zero and switches direction as arm 120 passes to either side of the intermediate position. Force (F) results primarily from spring 150 and component configuration and geometry of ear muff attachment assembly 100 and can be configured to result in a desired force at ear muff 130 as described herein.

Figure 3A:
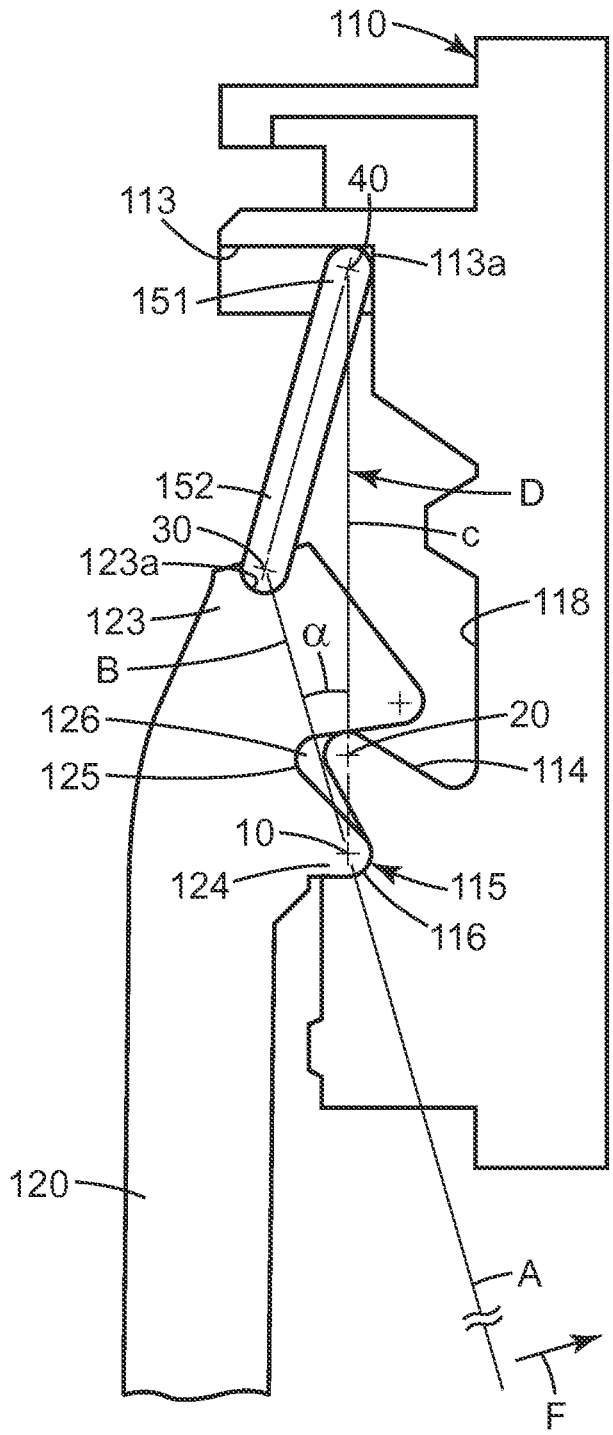
FIGS. 3*a*, 3*b*, and 3*c* show a representative schematic view of an exemplary ear muff attachment assembly 100 in first, intermediate, and second configurations.
Figure 3B:
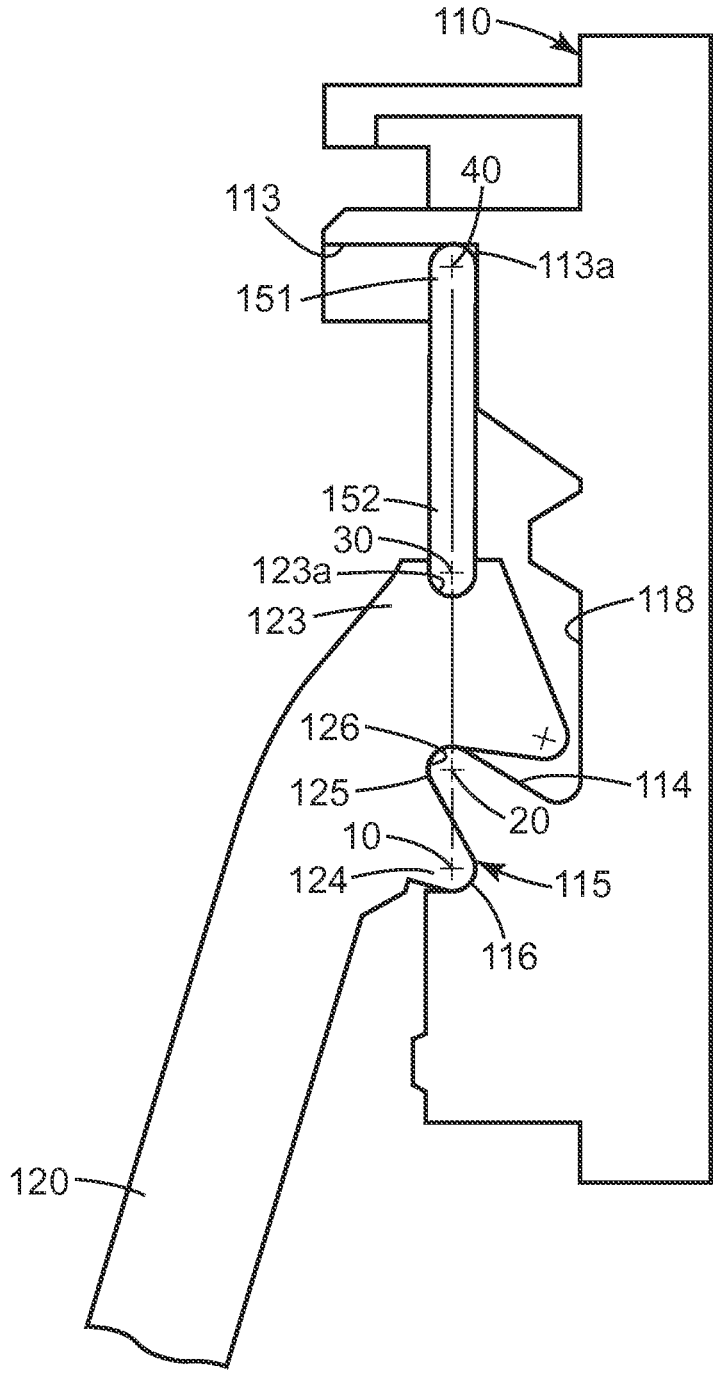
Figure 3C:
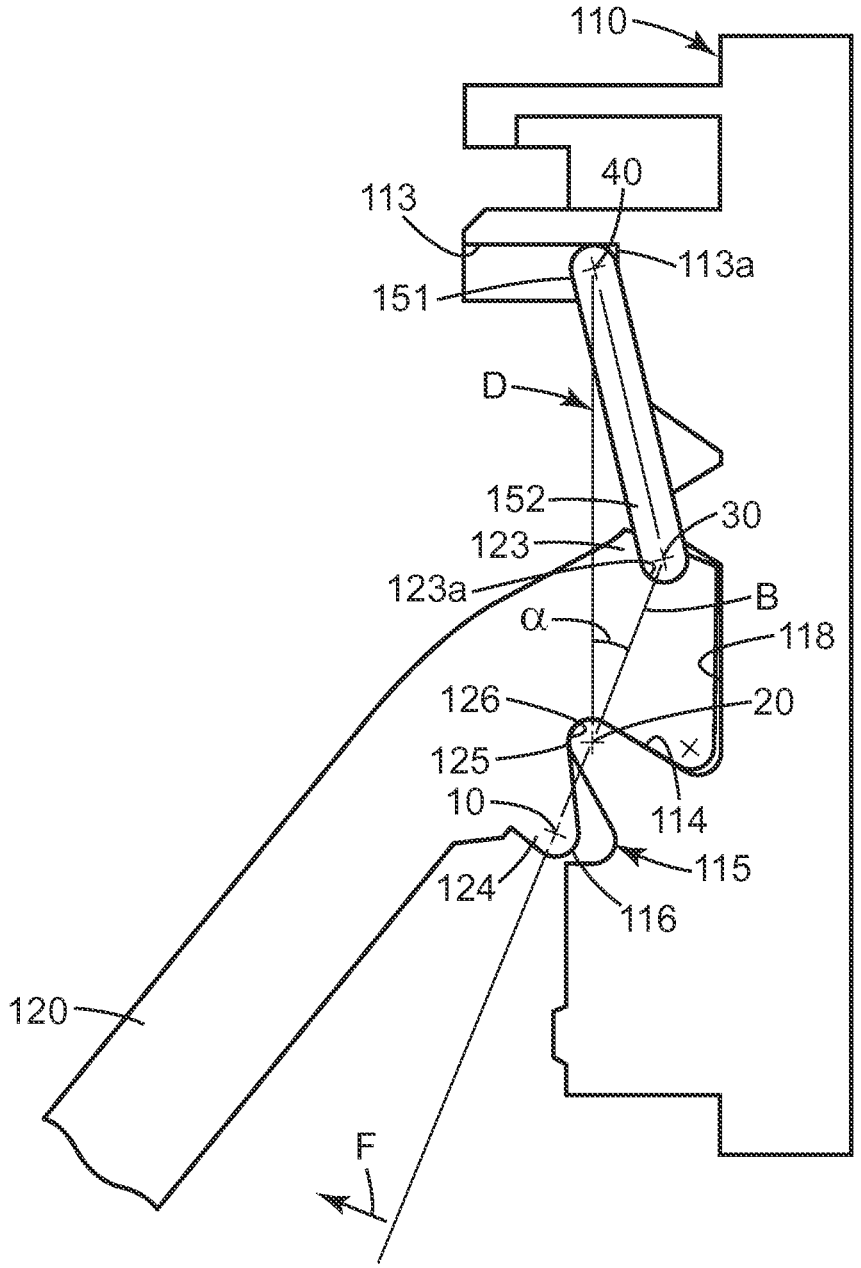

FIGS. 3*a* through 3*c* show cross-sectional schematic views of an exemplary ear muff attachment assembly 100 having an arm 120 in a first position, intermediate position, and second position, respectively. Arm 120 is rotatable about a first axis of rotation 10 between a first position (FIG. 3*a*) and an intermediate position (FIG. 3*b*), and about a second axis of rotation 20 between the intermediate position (FIG. 3*b*) and the second position (FIG. 3*c*). Rotation of arm 120 switches or flips from the first axis of rotation 10 to the second axis of rotation 20 at the intermediate position.

In an exemplary embodiment, first axis of rotation 10 is defined by a first lever seat 115 of housing 110. First lever seat 115 has a first depression or recess 116 configured to accommodate a complementary shaped arm protrusion 124 of arm 120. Arm protrusion 124 is able to rotate or pivot within first recess 116 about first axis 10 passing through arm protrusion 124 as arm 120 moves between first and intermediate positions. Second axis of rotation 20 is defined by a second lever seat 125 of arm 120. Second lever seat 125 has a second depression or recess 126 configured to accommodate a complementary shaped housing protrusion 114. Second depression or recess 126 is able to rotate or pivot over housing protrusion 114 about second axis 20 passing through housing protrusion 114 as arm 120 moves between the intermediate and second positions.

In various alternative exemplary embodiments, arm 120 may include first lever seat and housing 110 may include second lever seat, or arm 120 or housing 110 may include both of the first and second lever seats defining first and second axes of rotation 10, 20. First and second axes of rotation may be defined by other suitable shapes and/or features as known in the art.

FIG. 3*a* shows arm 120 of ear muff attachment assembly 100 in a first position in which ear muff 130 (not shown) is in an active position. Spring 150 exerts a spring force (Fs) at first end region 121 of arm 120 resulting in a force (F) at second end region 122 of arm 120 and ear muff 130 that causes ear muff 130 to press against the head and/or ear of a user. Force (F) acts to maintain ear muff 130 in the active position while providing an appropriate seal between ear muff 130 and the user's head and/or ear. A user may move ear muffs 130 away from their ear and out of the active position by overcoming force (F) and rotating or pivoting arm 120 past the intermediate position, for example.

FIG. 3*b*, shows arm 120 in an exemplary intermediate position in which first axis of rotation 10, and first and second spring engagement locations 151, 152, where spring 150 engages housing 110 and arm 120, respectively, are substantially aligned. In this intermediate position, spring 150 exhibits a maximum compression and exerts a maximum spring force (Fs). Spring force (Fs) acts in a direction extending though first and second axes of rotation 10, 20. Accordingly, the force (F) exerted at second end region of arm 120 and/or ear muff 130 is substantially zero. That is, at the intermediate position shown in FIG. 3*b*, spring force (Fs) does not result in a force acting to rotate arm 120. Movement of arm 120 away from the intermediate position results in a force (F) towards the first or second positions. For example, movement beyond the intermediate position away from the first position causes the direction of spring force (Fs) on arm 120 to flip or switch from being generally directed outwardly from housing 110 to being generally directed towards housing 110. Force (F) similarly flips or switches such that force (F) acts to move arm 120 and ear muffs 130 towards a second position, and rotation of arm 120 switches from rotation about first axis of rotation 10 to rotation about second axis of rotation 20.

FIG. 3*c* shows arm 120 in an exemplary second position in which ear muff 130 is in a standby position and ear muff 130 is raised and positioned away from and/or out of contact with a user's head. Spring 150 exerts a spring force (Fs) at first end region 121 of arm 122 that causes ear muff 130 to resist movement away from the standby position. First end region 121, or other portion of arm 120, is pushed against a stop 118 or other surface of housing 110 to prevent further rotation of arm 120 beyond the standby position. Accordingly, when resting in the standby position, force (F) is zero. A user may move ear muff 130 towards their ear and into an active position by moving ear muff 130 out of the standby position, overcoming force (F) acting to return arm 120 to the standby position, and rotating or pivoting arm 120 past the intermediate position, for example. When arm 120 passes the intermediate position, the direction of force (F) flips or switches and ear muff 130 is pushed into the active position.

Force (F) exerted at a second end region 122 of arm 120 and ear muff 130 is related to a position of arm 120 and compression or activation of spring 150. In an exemplary embodiment, force (F) may be described as acting in a direction parallel to the motion of second end region 122 of arm 120 and orthogonal to the axis of rotation. In embodiments in which arm 120 has a "Y" or branched configuration, force (F) may include a component acting at each attachment location, for example, such that force (F) is a total force acting on ear muff 130.

In the exemplary embodiment of FIGS. 3*a* through 3*c*, an approximate force (F) may be calculated based on a spring force (Fs), effective length (A) between the axis of rotation and location of force (F), length (B) between the arm axis of rotation and second spring engagement location 152, initial length (Li) of spring 150, compressed length (Ls) of spring 150, length (D) between the axis of rotation of arm 120 and first spring engagement location 151, angle (α) formed between (D) and (B), and lengths (C), (H1), and (H2), using the following relationships:

$$F=(Fs)*(H2)/(H1)$$

$$Fs=(Li-Ls)*K$$

$$H1=\cos(\alpha)*A$$

$$H2=\sin(\arccos(C/Ls)*D)$$

$$C=D-[\cos(\alpha)*B]$$

Lengths (H1), (H2), (Ls), and (C) vary as arm 120 moves between the first position and an intermediate position, and spring force (Fs) and force (F) similarly vary as arm 120 rotates and pivots. Lengths (A), (B), and (D) remain constant while arm travels between the first position and the second position. When arm 120 moves past the intermediate position, arm 120 switches or flips from rotation about first axis 10 to rotation about second axis 20 and lengths (A), (B), and (D) simultaneously change. In this way, force (F) also varies depending on whether arm 120 is between the first position and intermediate position or between the intermediate position and the second position, even for respective positions in which spring spring force (Fs) is equal. Accordingly, ear muff attachment assembly 100 allows a force (F) required to move ear muff 130 from the first position to the intermediate to be greater than the force (F) required to move ear muff 130 from the second position to the intermediate position. An ear muff attachment assembly having two axes of rotation and resulting in a lower force required to move ear muff from a second or standby position also allows for a greater flexibility in the distance traveled between the first and second positions. For example, because force (F) between the intermediate position and second position is lower, an ear muff may be positioned a greater distance from a user's head in the standby position, if desired.

In various exemplary embodiments, length (B) may be between about 3 mm and 25 mm, 8 mm and 17 mm, or about 11.5 mm, length (D) may be between about 10 mm and 30 mm, 15 mm and 25 mm, or about 22 mm, and ear muff attachment assembly may be configured such that angle (a) may be between 5° and 35°, 15° and 30°, or about 25° in the active and/or standby position. An ear muff attachment device having such values allows a configuration resulting in a desired force (F), spring force (Fs), and range of motion of arm 120 as described herein.

An ear muff attachment assembly having such geometry produces a maximum force between the first and intermediate positions (Fmax1) and a maximum force between second and intermediate positions (Fmax2). Maximum force (Fmax1) between first and intermediate positions represents a maximum force a user must exert to move ear muff 130 from a first, active position to a second, standby position, and maximum force (Fmax2) between second and intermediate positions represents a maximum force a user must exert to move ear muff 130 from a second, standby position to a first, active position. Ear muff attachment assembly 100 may be configured to have a desired variation between (Fmax1) and (Fmax2). In various exemplary embodiments, (Fmax2) is between 25% and 85% of (Fmax1), between 45 and 85% of (Fmax1), or about 75% of (Fmax1). In one exemplary embodiment, ear muff attachment assembly 100 has an initial spring length (Li) of 12.8 mm and spring constant (K) of 200 N/mm. When arm 120 is between a first position and an intermediate position, and rotates about first axis 10, ear muff attachment assembly 100 has lengths (A1) of 100 mm, (B1) of 11.5 mm, and (D1) of 22 mm. When arm 120 is between a second position and an intermediate position, and rotates about second axis 20, ear muff attachment assembly 100 has lengths (A2) of 103.8 mm, (B2) of 7.7 mm, and (D2) of 18.2. An ear muff attachment assembly having such geometry produces a maximum force (Fmax1) between the first and intermediate positions of approximately 18.1 N and a maximum force (Fmax2) between second and intermediate positions of 13.3 N.

An ear muff attachment assembly as described herein provides several features and advantages over prior devices. An ear muff attachment assembly having two axes of rotation facilitates an assembly that allows an ear muff to be moved into an active position with much less force than required to move the ear muff into a standby position. The force required to move the ear muff may be calibrated such that a maximum force a user must exert to move the ear muff from an active position to a standby position is less than, or exhibits a preferred value, as compared to a maximum force a user must exert to move the ear muff from a standby position to an active position. A user is able to readily and comfortably rotate or pivot arm 120 and spring force (Fs). Further, an exemplary ear muff attachment assembly may be configured such that an arm has a greater range of motion while exhibiting a desired force (F), and an ear muff may reside in a standby position that is a greater distance from a user's head. Additionally, an ear muff attachment assembly having two axes of rotation allows the above advantages to be achieved while minimizing a force exerted by a spring component when the arm and earmuff are in a standby position. Such a configuration reduces stress on a housing and/or other components of the ear muff attachment assembly and provides a durable and robust assembly.

The present disclosure has now been described with reference to several embodiments thereof. The foregoing detailed description and examples have been given for clarity of understanding only. No unnecessary limitations are to be understood therefrom. It will be apparent to those skilled in the art that many changes can be made in the embodiments described without departing from the scope of the invention. Thus, the scope of the present invention should not be limited to the exact details and structures described herein, but rather by the structures described by the language of the claims, and the equivalents of those structures. Any feature or characteristic described with respect to any of the above embodiments can be incorporated individually or in combination with any other feature or characteristic, and are presented in the above order and combinations for clarity only. That is, the present description contemplates all possible combinations and arrangements of various features of each of the exemplary embodiments and components describe herein, and each component may be combined or used in conjunction with any other component as desired for a particular application.

What is claimed is:

1. An ear muff attachment assembly, comprising:

a housing with a protrusion that forms a first lever seat and a second lever seat on the housing and;

an ear muff;

an arm comprising a first end region and a second end region, wherein the first end region comprises a first lever seat engaging structure, extending from the arm, and a second lever seat engaging structure, extending from the arm;

wherein the first lever seat engaging structure, when engaging the first lever seat, forms a first axis of rotation for the arm, and wherein the second lever seat engaging structure, when engaging the second lever seat, forms a second axis of rotation for the arm;

wherein the arm is rotatable about the first axis of rotation between a first position and an intermediate position, and about the second axis of rotation between the intermediate position and a second position, and wherein the protrusion interacts with the arm such that the protrusion is in between the first and second lever seat engaging structures as the arm moves between the first position, the intermediate position, and the second position; and wherein a spring is positioned within the housing and contacts a spring retention feature of the first end region on a first spring end and contacts the housing on a second spring end, and wherein the spring exerts a first spring force between the first position and the intermediate position that acts to return the arm to the first position, and a second spring force between the intermediate position and the second position that acts to return the arm to the second position, and wherein the spring retention feature comprises a recess.

2. The ear muff attachment assembly of claim 1, wherein the first lever seat engaging structure and the second lever seat engaging structure are positioned on the arm to form a recess on the arm that receives the protrusion, wherein the protrusion is a shaped such that it engages the first and second lever seat engaging structures, respectively, in each of the first and second positions.

3. The ear muff attachment assembly of claim 1, wherein the first and second lever seat engaging structures are positioned on the arm such that a groove is formed, wherein the groove receives the protrusion.

4. The ear muff attachment assembly of claim 1, wherein the first and second axes of rotation are parallel.

5. The ear muff attachment assembly of claim 1, wherein the spring is a spring selected from the group consisting of a coil spring, leaf spring, and wire spring.

6. The ear muff attachment assembly of claim 1, wherein the ear muff is in an active position configured to cover a user's ear when the arm is in the first position and the ear muff is in a standby position away from a user's ear when the arm is in the second position.

7. The ear muff attachment assembly of claim 6, wherein the arm exerts a force (F) at the second end region, and a first maximum force exerted between the first position and the intermediate position (Fmax1) is greater than a second maximum force (Fmax2) exerted between the intermediate position and the second position.

8. The ear muff attachment assembly of claim 1, wherein the ear muff is removably attached to the second end of the arm.

9. The ear muff attachment assembly of claim 1, wherein the ear muff is adjustably attached to the second end of the arm.

10. An ear muff attachment assembly, comprising:

a housing comprising a first lever seat defining a first axis of rotation and a second lever seat defining a second axis of rotation and a protrusion between the first and second lever seats;

an arm comprising a first end region and a second end region, the first end region comprising a first lever seat engaging structure and a second lever seat engaging structure that are each rotatably engageable with the first and second lever seats, respectively, and wherein the first and second lever seat engaging structures are positioned on the arm on either side of a recess that receives the protrusion, and wherein the engagement between the first and second lever seat engaging structures and the first and second lever seats allow the earmuff attachment assembly to move around the first and second axes of rotation, wherein the second axis of rotation is parallel to the first axis of rotation, and the second end region comprises an ear muff; and a spring within the housing that is attached to a spring retention feature on the first end region of the arm within the housing, on a first spring end, and is attached to the housing on a spring second end, and wherein the spring retention feature is a recess that receives the spring;

wherein the arm is rotatable about the first axis of rotation between a first position and an intermediate position, and about the second axis of rotation between the intermediate position and a second position, and wherein the spring is rotatably engageable such that it exerts a first spring force between the first position and the intermediate position that acts to return the arm to the first position, and exerts a second spring force between the intermediate position and the second position that acts to return the arm to the second position.

11. An ear muff device, comprising:

a helmet; and a first earmuff attachment assembly and a second ear muff attachment assemblies, each attached to the helmet, each of the first and second ear muff attachment assemblies comprising:

an earmuff housing comprising a first lever seat defining a first axis of rotation and a second lever seat defining a second axis of rotation, wherein the first and second lever seats are positioned, respectively, above and below a protrusion on the earmuff housing;

an arm comprising first and second end regions, the first end region comprising a first lever seat engaging structure that rotatably engages the first lever seat, and a second lever seat engaging structure that rotatably engages the second lever seat, and wherein the engagement between the first and second lever seats and the first and second lever engaging structures causes one of the first or second earmuff attachment assemblies to rotate about the protrusion on the first and second axes of rotation, wherein the second axis of rotation is parallel to the first axis of rotation, and the second end region comprises an ear muff; and a spring attached to the earmuff housing on a first spring end and contacts, on a second spring end a recess in the first end region of the arm within the housing;

wherein the arm is rotatable about the first axis of rotation between a first and an intermediate position such that the arm rotates about the protrusion in the first lever seat between the first and intermediate position, and about the second axis of rotation between the intermediate position and a second position such that the arm rotates about the protrusion in the second lever seat between the intermediate and the second position, and wherein the spring exerts a first spring force between the first position and the intermediate position that acts to return the arm to the first position, and a second spring force between the intermediate position and the second position that acts to return the arm to the second position.

12. The ear muff device of claim 11, further comprising an adapter attachable to the helmet and having a slot configured to slidably receive a mating feature of the housing.

13. The ear muff device of claim 11, wherein the first position the ear muff is in an engaged position configured to cover a user's ear and the second position is a second engaged position configured to position the ear muff over a user's ear.

* * * * *